US005406971A

United States Patent [19]

Taylor

[11] Patent Number: 5,406,971

[45] Date of Patent: Apr. 18, 1995

[54] HAIR REPLACEMENT DEVICE AND METHOD OF CONSTRUCTION

[75] Inventor: Greg A. Taylor, Burlingame, Calif.

[73] Assignee: Taylor Topper, Inc., Millbrae, Calif.

[21] Appl. No.: 75,776

[22] Filed: Jun. 11, 1993

[51] Int. Cl.[6] ..... A41G 5/00

[52] U.S. Cl. ..... 132/201; 132/56

[58] Field of Search ..... 132/53, 54, 56, 201

[56] References Cited

U.S. PATENT DOCUMENTS

| | | | |
|---|---|---|---|
| 3,645,280 | 2/1972 | Cutler et al. . | |
| 3,651,821 | 3/1972 | Mielke . | |
| 3,970,092 | 7/1976 | Nelson | 132/201 |
| 4,386,619 | 6/1983 | Williams . | |
| 4,606,359 | 8/1986 | Palumbo et al. | 132/53 |
| 4,658,841 | 4/1987 | Won . | |
| 4,799,502 | 1/1989 | Kobayashi et al. | 132/53 |
| 5,010,914 | 4/1991 | Merges . | |
| 5,044,382 | 9/1991 | Ando et al. . | |

FOREIGN PATENT DOCUMENTS

| | | | |
|---|---|---|---|
| 9014777 | 12/1990 | WIPO | 132/53 |

*Primary Examiner*—John G. Weiss

*Attorney, Agent, or Firm*—Janet K. Castaneda; James E. Eakin

[57] ABSTRACT

A hair replacement device is constructed from hollow, polyurethane tubing reinforced with copper wire to prevent stretching and to allow the device to be molded, and re-molded, to conform to the contours of the scalp. The copper wire is coated with a flesh color substance. The device defines a peripheral segment and longitudinal and lateral tubing intertwined and glued at intersecting areas to form a generally basket shaped device. Hair is conventionally attached to the plastic tubing, and a skin panel insert may be added where desired. The hair of an individual may be draw through the open framework and blended with the hair attached to the device.

8 Claims, 1 Drawing Sheet

HAIR REPLACEMENT DEVICE AND METHOD OF CONSTRUCTION

FIELD OF THE INVENTION

The present invention relates to hair replacement devices. More particularly, the invention relates to a hair replacement cap, primarily designed to augment existing hair, and constructed from intertwined segments of plastic tubing re-enforced with a coated malleable wire to maintain shape and better conform to the head of the wearer.

BACKGROUND OF THE INVENTION

Hair replacement devices and wigs are known in the art. Wigs typically are constructed for placement on top of an individual's remaining hair and other hair replacement devices typically are constructed to augment an individual's remaining hair.

Wigs generally require a relatively tight fit on the scalp, particularly around the periphery of the wig, for stability. Wigs generally are constructed from materials simulating skin, from mesh or netlike materials, or from plastic frameworks. Some of the problems associated with wigs include excessive heat at the scalp and pressure or pinching from the required tight fit. The more open framework designs, including mesh or net wigs, developed to resolve these problems have been only partially successful. The continuing requirement for stability made some of the wig designs bulky and uncomfortable, and the less bulky, more open designs frequently did not maintain their shape over time. Several prior art wigs are described in U.S. Pat. Nos. 3,645,280 and the 4,658,841.

Hair replacement devices constructed to augment hair offer the individual with some hair, or thinning hair, an alternative to the full wig. Such hair replacement devices generally are constructed in an open framework with hair tied, glued or sewn to the framework. The individual's hair is drawn through the open areas of the framework and intermixed with the hair of the device.

Hair replacement devices must closely fit the contours of the individual scalp to allow the hair to be intermixed, typically by combing, and they must be constructed from materials that retain their shape over time to prevent sagging from the weight of the attached hair and from incidental tugging or snagging as the hair is blended. Additionally, connections between segments of the open framework must be strong, but not bulky, to withstand incidental tugging or snagging as the hair is blended.

U.S. Pat. No. 3,651,821 describes a hairpiece defining typically three, wide hair-carrying webbed bands placed as strips across the head and attached at the ends to a U-shaped elastic band extending around the periphery of the hair line.

U.S. Pat. No. 4,386,619 describes a cap made of an elastic netting framework designed to provide hair of a different color to achieve a "frosting" effect. The framework includes an outer member, supporting members and inner members in an elaborate design.

U.S. Pat. No. 5,010,914 describes a device defining a plurality of plastic rods radiating outwardly from a central piece at the crown of the head.

U.S. Pat. No. 5,044,382 describes a device defining a cap made from an elastic material and having chain-like elements for intermingling the hair of the individual with the hair attached to the device.

The prior art hair replacement devices described, while generally more comfortable than full wigs, have disadvantages. The materials used to construct the devices, in combination with the open framework designs, typically cannot maintain their shape over time. Elastic materials sag because of the weight of the attached hair thereby preventing the device from fitting closely to the contour of the head. Plastic materials may maintain their shape longer, but typically are not sufficiently malleable to hug the contours of the scalp closely. Additionally, the small surface area available to attach segments to each other, typically with an adhesive, frequently cannot withstand tugging or snagging from, for instance, the bristles of a hair brush.

A heretofore unmet need exists for a comfortable, light weight hair replacement device that maintains its shape and may be conformed closely to the contours of the scalp.

SUMMARY OF THE INVENTION WITH OBJECTS

A general object of the present invention is to provide a hair replacement device that overcomes the limitations and drawbacks of the prior art.

A specific object of the present invention is to provide a hair replacement device constructed from plastic tubing reinforced with a malleable metal wire enabling the device to be conformed to the contours of the scalp, the reinforcement further maintaining the shape of the plastic tubing.

Another specific object of the present invention is to provide a hair replacement device wherein the reinforcing wire in the plastic tubing is coated to simulate the color of the scalp.

Still another specific object of the present invention is to provide a hair replacement device with an open framework of plastic reinforced tubing wherein the tubing sections are intertwined at intersecting areas for stability and the intertwined areas are further stabilized by application of an adhesive.

Yet another specific object of the present invention is to provide a basket shaped hair replacement device constructed from polyurethane tubing reinforced with coated copper wire wherein the tubing is intertwined and glued at intersecting areas of the basket shaped device.

In accordance with the present invention, a basket shaped hair replacement device includes a plurality of longitudinally extending, hollow, plastic tubes extending from a generally circular perimeter from the back to the front of the head, and a number of laterally extending, hollow, plastic tubes extending from the perimeter, at substantially right angles to the first plurality, at one side of the head to the other side of the head. At intersecting areas, one tube is intertwined about the intersecting tube. An adhesive is also applied at the intertwined areas. All of the hollow tubes are reinforced with a malleable metal wire insert to prevent stretching and to allow the device to be pressed into the contours of the head. The wire is coated with a flesh color material. Hair is conventionally attached to the plastic tubing.

In another aspect of the invention, a skin panel may be selectively inserted, for instance, at the front or crown area of the scalp to cover areas where the hair loss is total.

The device is constructed as follows:

1. A selected length of a malleable, bendable metal wire is coated with a skin color substance.
2. The wire is threaded into the lumen of a selected length of plastic tubing.
3. A peripheral segment is cut to length from the tubing to encircle the hair line of the individual.
4. The cut ends of the peripheral segment are attached together.
5. A strip of an elastomeric material may be attached to the inside surface of one or more selected areas of the peripheral segment for expansion and increased stability on the head.
6. The reinforced length of tubing is further cut into a number of longitudinal and lateral segments having lengths sufficient to form a basket like framework to conform to the shape of the scalp.
7. A U-shaped segment is preferably cut from the reinforced length of tubing and each cut end is attached to the front of the peripheral segment.
8. The first cut ends of the longitudinal segments are selectively spaced apart and attached to the rear portion of the peripheral segment at the back of the head, and the segments are extended from the rear to the front where they are attached at intervals to the U-shaped segment or to the inside of the rear of the peripheral segment.
9. The first cut ends of the lateral segments are selectively spaced apart and attached to one side of the peripheral segment thereby oriented generally perpendicular to the first segments.
10. The free end of each lateral segment is wrapped around each longitudinal segment in turn, thereby forming a loop to intertwine the segments at intersections thereof, as the lateral segment is advanced across to the other side of the head where it is attached to the other side of the peripheral segment.
11. All intersecting areas are further secured with a suitable adhesive.

These and other objects, aspects, advantages and features of the present invention will be more fully understood and appreciated upon consideration of the following detailed description of preferred embodiments, presented in conjunction with the accompanying drawings.

DETAILED DESCRIPTION OF PREFERRED EMBODIMENTS

Figure 1:
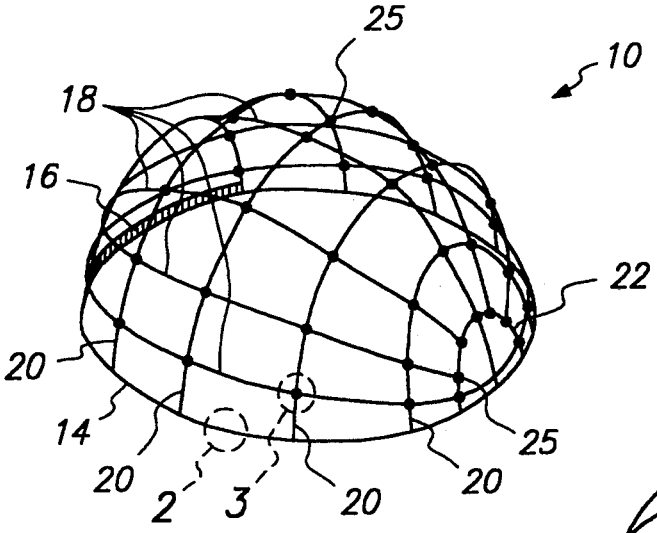
FIG. 1 is an elevated, right frontal, perspective view of a preferred hair enhancement device embodying the principles of the present invention. The device is shown without hair.
Figure 2:
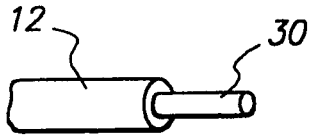
FIG. 2 is an enlarged detail, partially cut away, and showing the copper wire inserted within the plastic tubing.
Figure 3:
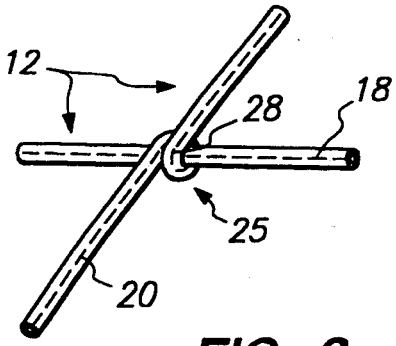
FIG. 3 is an enlarged detail of the intertwining shown as circle 3 in FIG. 1.

Referring to FIGS. 1, 2, and 3, a preferred hair replacement device embodying the principles of the present invention is shown generally at 10. The right frontal, elevated view of the device is shown without attached hair.

The hair replacement device 10 defines generally a basket, and in the example shown, is designed to surround the hair line and cover the entire scalp.

The device 10 is constructed preferably from hollow, clear, plastic tubing 12, preferably polyurethane tubing, although other flexible, strong plastic tubing having properties similar to polyurethane may be used. The diameter of the tubing is approximately 1/16 inch, although larger diameters may be used if desired.

Referring now to FIG. 2, the plastic tubing 12 is reinforced with a malleable, flexible metal wire 30 which is threaded through the lumen of the plastic tubing 12. The preferred wire 30 is made from copper, but other soft, light weight, bendable materials may be used, such as soft aluminum. The wire 30 reinforces the plastic tubing 12 thereby preventing stretching and sagging. The wire 30 further allows the device 10 to be molded and pressed to the exact contours of the scalp for a custom and stable fit. The wire is preferably coated with a flesh colored paint developed specifically for coating bendable wire without cracking or delaminating. The paint further prevents the wire from being visible against the scalp.

The device 10 shown in FIG. 1 includes a peripheral segment 14 designed to encircle the head in the area of the hairline. The segment 14 is preferably formed from the reinforced plastic tubing 12, but portions of segment 14 may also include a conventional elastomeric material. It is preferred to attach, by sewing or with an adhesive substance, an elastomeric band 16 to the skin side of the peripheral segment 16 to help stabilize and maintain the device 10 on the head. As shown in FIG. 1, the band 16 is secured at the back of the device 10 so that it will rest against the back of the head underneath the occipital crest of the wearer's skull.

A selected number of reinforced longitudinal plastic segments 18 are spaced as desired and attached at a first end to a U-shaped segment 22 that may be added to enhance spacing. The longitudinal plastic segments 18 are extended substantially parallel to each other around the circumference of the cap 10 and attached at opposite ends thereof to the opposite side of the U-shaped segment 22. A central longitudinal segment 24 extends from the front of the cap to attach to the peripheral segment 14 at the back of the device 10. In the example shown, five longitudinal segments 18 are shown, with an additional lowermost segment positioned above the peripheral segment 14 and extending to encircle the entire device 10. The segments 18 are attached by sewing or with a suitable adhesive.

Figure 6:
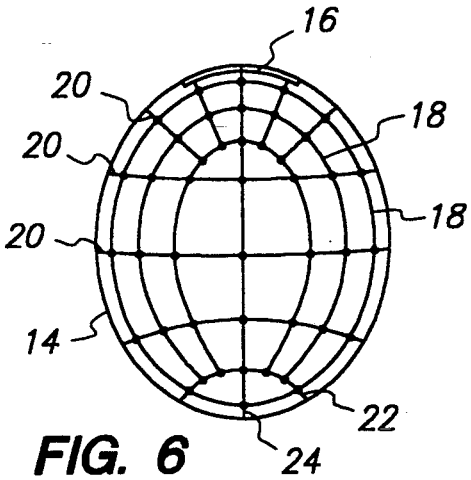
FIG. 6 is a top view of the cap of FIG. 1.

A selected number of reinforced lateral plastic segments 20 are spaced as desired and attached to the peripheral segment 14. Some of the lateral plastic segments 20 extend across the scalp to the opposite side of the head at substantially right angles to the longitudinal segments 18. Other lateral plastic segments 20 extend from the peripheral segment 14 to attach to the uppermost longitudinal segments 18 as best seen in FIG. 6.

As best shown in FIG. 3, at intersecting areas 25 between segments 18 and 20, segments 18 are intertwined about each intersecting segment 20. As an end of segment 20 reaches a segment 18, the end is placed over segment 18, brought back under segment 18, and again brought over segment 18 to form a loop before extending to the next adjacent segment 18 where the process is repeated. It will be recognized by those skilled in the art that either segment 18, 20 may be used to form the loop 28 and that the loop 28 may be formed in other suitable knotting arrangements. The loops 28 help to secure the position of the segments 18, 20. It is preferable to apply a suitable adhesive, such as polyurethane glue, at the intersecting areas 25 to prevent separation thereof.

Figure 4A:
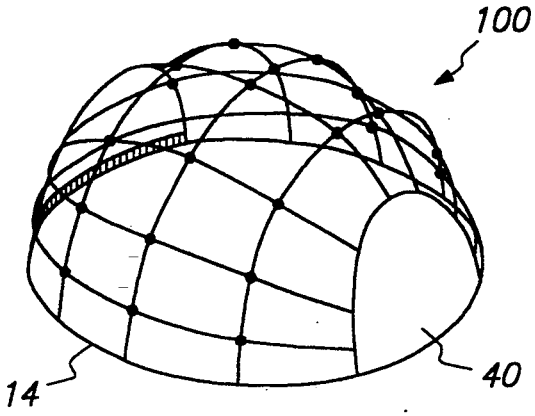
FIGS. 4A and 4B are elevated perspective views of alternative designs for the hair replacement device having, respectively, a skin tone insert at the front of the hairline and a skin tone insert extending from the front of the hair line and covering the crown of the head.
Figure 4B:
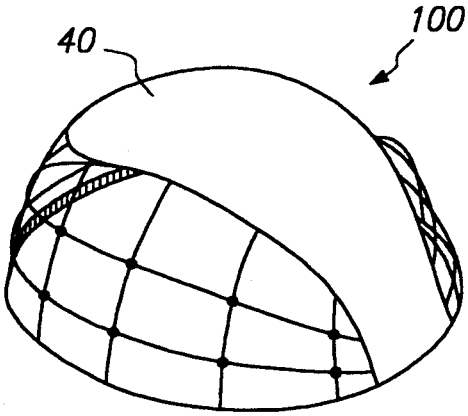

In another aspect of the invention shown in FIGS. 4A and 4B, a hair replacement device 100 includes a polyurethane skin panel 40 which may be selectively inserted, for instance, at the front and/or crown area of the scalp to cover areas where hair loss is total. The skin panel 40 is sewn or glued to the segments 18, 20.

Figure 5:
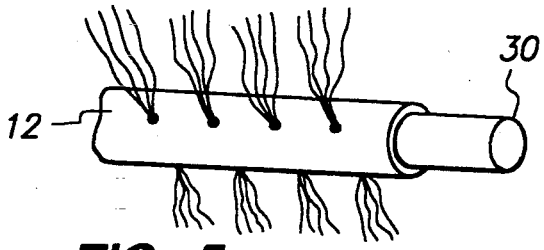
FIG. 5 is an enlarged section of a plastic tube, partially cut away to show the metal wire insert, and shown with hair sewn into the tubing and knotted.

Referring now to FIG. 5, hair is conventionally attached to the plastic tubing using a conventional barb device and a ventilating technique. As is well known in the art, the hair is inserted into the tubing using a barbed device. The hair is preferably knotted after attachment to the tubing. It will be recognized by those skilled in the art that the hair may also be attached by other suitable methods, such as tying or gluing.

For use, the device is placed over the head, positioned as desired, and pressed against the scalp so that the bendable copper wire molds the device to the contours of the head. The wearer's remaining hair is drawn through the open areas of the device 10 and the hair is brushed to blend the wearer's hair with the hair of the device 10.

The device may be washed in a conventional fashion.

The device is constructed as follows:

1. A selected length of copper wire is coated with a skin color substance.
2. The copper wire is threaded into the lumen of a selected length of polyurethane tubing.
3. A peripheral segment is cut to length from the tubing to encircle the hair line of the individual.
4. The cut ends of the peripheral segment are attached together by sewing or by a suitable adhesive substance.
5. A strip of an elastomeric material may be attached to the inside surface of one or more selected areas of the peripheral segment for stability.
6. The reinforced length of tubing is further cut into a number of longitudinal and lateral segments having lengths sufficient to form a basket like framework to conform to the shape of the scalp.
7. A U-shaped segment is cut from the reinforced length of tubing and each cut end is attached be sewing or an adhesive to the front of the peripheral segment.
8. A central longitudinal segment is attached at a first end to the peripheral segment at the front and extended to attached the second end to the peripheral segment at the rear.
9. The first cut ends of the remaining selected longitudinal segments are selectively spaced apart and attached by sewing or an adhesive to one side of the U-shaped segment at the front of the cap, and the segments are extended around the circumference of the cap, substantially parallel to the peripheral segment where they are attached at opposite ends thereof to the opposite side of the U-shaped segment.
10. The first cut ends of the lateral segments are selectively spaced apart and attached by sewing or an adhesive to the peripheral segment thereby oriented perpendicular to the first segments.
11. The free end of each lateral segment is wrapped around each longitudinal segment in turn, thereby forming a loop to intertwine the segments at intersections thereof, as the lateral segment is advanced either across to the other side of the head to attach to the other side of the peripheral segment, or advanced to the uppermost longitudinal segment for attachment thereto.
12. All intersecting areas are further secured with a suitable adhesive.

To those skilled in the art to which the present invention pertains, many widely varying embodiments and implementations of the principles of the present invention will be suggested from the foregoing. For instance, the basket shaped framework may include additional segments extending in any desired direction, or the device may be made from one or more continuous lengths of reinforced wire. The description and the disclosures presented herein are by way of illustration only and should not be considered to limit the present invention, the scope of which is more particularly set forth in the following claims.

What is claimed is:

1. A hair replacement cap comprising:

a generally elliptical periphery band sized to extend around a hair line area of a head;

a plurality of plastic tubing segments extending between a front and a back of the periphery band, and between opposite sides of the periphery band, the plastic tubing segments and periphery band defining a cap having open spaces between intersections of the plastic tubing segments, the intersections having the plastic tubing segments intertwined to form a loop at each intersection;

adhesive means for securing the tubing segments at at least one of the intersections;

bendable, flesh colored wire means threaded through a lumen of the plastic tubing segments, the wire means for molding the cap to conform to a contour of the head; and a plurality of hair strands attached to the plastic tubing segments, the cap allowing hair of a wearer to be drawn through the open spaces for blending with the plurality of hair strands on the plastic tubing segments.

2. The hair replacement cap of claim 1 further comprising an elastomeric flesh colored insert.

3. A method for constructing a hair replacement cap comprising:

a. coating a selected length of maleable wire with a skin colored substance;

b. attaching the wire to a selected length of tubing made from a plastic material;

c. forming a peripheral segment from the tubing at a length sufficient to encircle a hair line of an individual;

d. forming a number of segments from the tubing having lengths sufficient to form a basket like latticework having intersecting areas to conform to a contour of the individual's head;

e. selectively spacing and positioning a first portion of the number of segments to form generally longitudinal segments between a rear and a front portion of the peripheral segment;

f. selectively spacing and positioning a second portion of the number of segments between a first and a second side of the peripheral segment to form generally lateral segments generally perpendicular to the longitudinal segments; and g. the selectively spacing and positioning including the step of wrapping lateral segments around longitudinal segments to form a loop at each of the intersecting areas.

4. The method of claim 3 further comprising the step of attaching at least one skin color insert in at least one selected area.

5. The method of claim 3 further comprising the step of attaching an elastomeric strip to an inside surface of the peripheral segment.

6. The method of claim 3 further comprising the step of applying an adhesive substance to intersecting areas.

7. The method of claim 3 wherein the step of attaching the maleable wire to the selected length of tubing further comprising threading the maleable wire through a lumen of the tubing.

8. The method of claim 3 wherein the step of wrapping comprises wrapping longitudinal segments around lateral segments to form a loop at intersecting areas.

* * * * *